US006425223B1

(12) United States Patent
Miller et al.

(10) Patent No.: US 6,425,223 B1
(45) Date of Patent: Jul. 30, 2002

(54) METHOD AND DEVICE FOR MAINTAINING THE OPENING POSITION OF AN ENVELOPE

(75) Inventors: John Miller, Shelton, CT (US); Joseph Pinheiro, Jr., Troy, NY (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/408,054

(22) Filed: Sep. 29, 1999

(51) Int. Cl.[7] ..... B65B 43/26
(52) U.S. Cl. ..... 53/381.6; 53/381.7
(58) Field of Search ..... 53/381.6, 381.5, 53/381.7, 386.1, 492

(56) References Cited

U.S. PATENT DOCUMENTS 4,035,988 A * 7/1977 Daniels
4,776,152 A * 10/1988 Kruk
4,835,941 A * 6/1989 Torii et al.
5,052,168 A 10/1991 DeWitt et al. ..... 53/492
5,447,015 A * 9/1995 Belec et al.
5,581,972 A * 12/1996 Antonelli
6,164,043 A * 12/2000 Miller et al.

* cited by examiner

*Primary Examiner*—Eugene Kim
(74) *Attorney, Agent, or Firm*—Alberta A. Vitale; Angelo N. Chaclas; Charles R. Malandra, Jr.

(57) ABSTRACT

A device to lift a throat of an envelope to spread open the envelope. The device comprises a suction cup mounted to a pitching arm; a hook movably mounted adjacent to the suction cup; means for lowering the pitching arm to allow the suction cup to seal with the throat with a suction force, and raising the pitching arm to allow the suction cup to lift the throat; and an actuation device for placing the hook under the throat after the throat has been lifted by the suction cup so as to mechanically maintain the lifted position of the throat. Accordingly, the method of maintaining the lifted position of a throat includes the steps of: 1) positioning the suction cup over the throat; 2) pressing the suction cup against the throat to seal with the throat; 3) raising the suction cup to lift the throat; and 4) placing the hook under the lifted throat to mechanically maintain the lifted position of the throat. It is preferred that the suction force can be provided by a vacuum pump, and preferably a piston operated vacuum pump.

9 Claims, 7 Drawing Sheets

METHOD AND DEVICE FOR MAINTAINING THE OPENING POSITION OF AN ENVELOPE

TECHNICAL FIELD

The present invention relates generally to a document inserting machine and, more specifically, an envelope opening device in the inserting machine.

BACKGROUND OF THE INVENTION

In an inserting machine for mass mailing, there is a gathering section where enclosure material is gathered before it is inserted into an envelope. This gathering section is sometimes referred to as a chassis subsystem, which includes a gathering transport with pusher fingers rigidly attached to a conveyor belt and a plurality of enclosure feeders mounted above the transport. If the enclosure material contains many documents, these documents must be separately fed from different enclosure feeders. After all the released documents are gathered, they are put into a stack to be inserted into an envelope in an inserting station. Envelopes are separately fed to the inserting station, one at a time, and each envelope is placed on a platform facing down with its flap flipped back all the way. At the same time, mechanical fingers or a vacuum suction device are used to hold the front face of the envelope on the platform while the throat portion of the back face of the envelope is pulled upward to open the envelope. The stack of enclosure material is than automatically inserted into the opened envelope.

In the past, vacuum suction has been used to open envelopes as a precursor to material insertion. For example, U.S. Pat. No. 5,052,168 (DeWitt el al.) discloses a method and an apparatus to spread open an envelope where two suction cups are placed on the opposing faces of the envelope. An air flow is drawn through two respective suction arms to produce a negative air pressure to allow the suction cups to seal with the respective faces of the envelope. The suction cups are then moved away from each other in order to spread open the envelope. A vacuum pump, along with a plurality of bleed valves, release valves and dump valves, is used to produce the necessary suction force. In the method disclosed by DeWitt et al, only one suction cup is used to pick up the throat of the envelope. In general, it is preferred that a number of suction cups be positioned around the throat section of the envelope in order to spread open the envelope. The number of suction cups used is usually determined by the width of the envelope. As shown in FIG. 1, an envelope 100 has a flap 102 and a throat portion 104. After the flap 102 is flipped out as illustrated, four section-cups are evenly spaced around the throat portion 104 at four pickup points A, B, C and D to open the envelope 100.

Like other similar designs, the method disclosed by DeWitt et al. uses a constantly running vacuum pump to draw the air flow in order to open and maintain the opening position of envelopes for either material insertion or extraction. The various valves in the vacuum manifold are opened or closed whenever vacuum is required for the suction cups to pick up the faces of the envelope. Typically, a large A.C. vacuum pump is required to produce the necessary suction force. The disadvantages of using such a vacuum pump in an inserting machine include:

1) energy is wasted because the power consumption of a large pump is high;
2) energy is wasted because the pump is kept running even when it is not used to open an envelope; and
3) the noise levels generated by the constantly running pump are high.

It is advantageous to provide a method and a device for opening envelopes in an inserter station wherein the vacuum or low air pressure needed for suction is produced intermittently for a short period of time and, after the throat is opened, the envelope opening position can be mechanically maintained as long as it is required without relying on the suction force within the suction cup.

SUMMARY OF THE INVENTION

The device to spread open an envelope having a throat, according to the present invention, includes: a pitching arm; a suction cup attached to the pitching arm; a hook located adjacent to the suction cup; a pitching device for pitching the pitching arm in a first direction to cause the suction cup to contact and to seal with the throat by a suction force within the suction cup, and for pitching the pitching arm in a second direction to cause the suction cup to lift the throat to spread open the envelope into an opening position; and an actuator for causing the hook to be placed under the throat after the throat has been lifted by the suction cup so as to mechanically maintain the envelope in the opening position at times when the suction force is removed.

Accordingly, the method to spread open an envelope having a throat, wherein a suction cup is used to lift the throat to spread open the envelope into an envelope opening position, includes the steps of: 1) positioning the suction cup over the throat of the envelope; 2) moving the suction cup into contact with the throat; 3) lifting the throat by the suction device to spread open the envelope into the envelope opening position; and 4) placing a mechanical device under the throat so as to maintain the envelope opening position.

The above method further includes the step of removing the mechanical device from the throat, releasing the throat from the suction cup, and preparing the device for opening another envelope in the next cycle.

The method and device for maintaining the opening position of an envelope will become apparent upon reading the description taken in conjunction with FIG. 2 to FIG. 7.

DETAILED DESCRIPTION

FIGS. 2 through 5 illustrate an envelope opening device 10, according to the preferred embodiment of the present invention. Each figure shows a different stage of an envelope opening cycle. The envelope opening device 10 can be used in an inserting machine or any other machine where envelopes are opened, one at a time, to allow enclosure material to be inserted into or extracted from the envelope.

Figure 1:
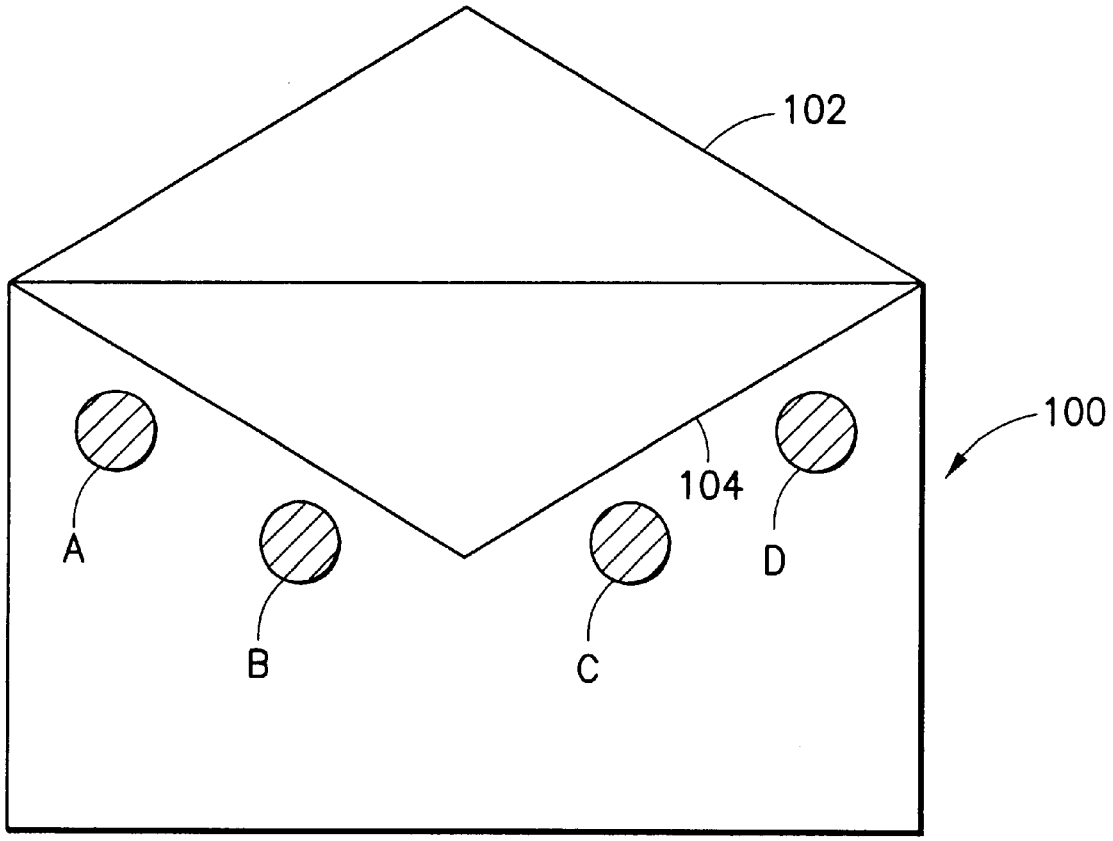
FIG. 1 illustrates a typical envelope having four pickup points in the throat portion.
Figure 2:
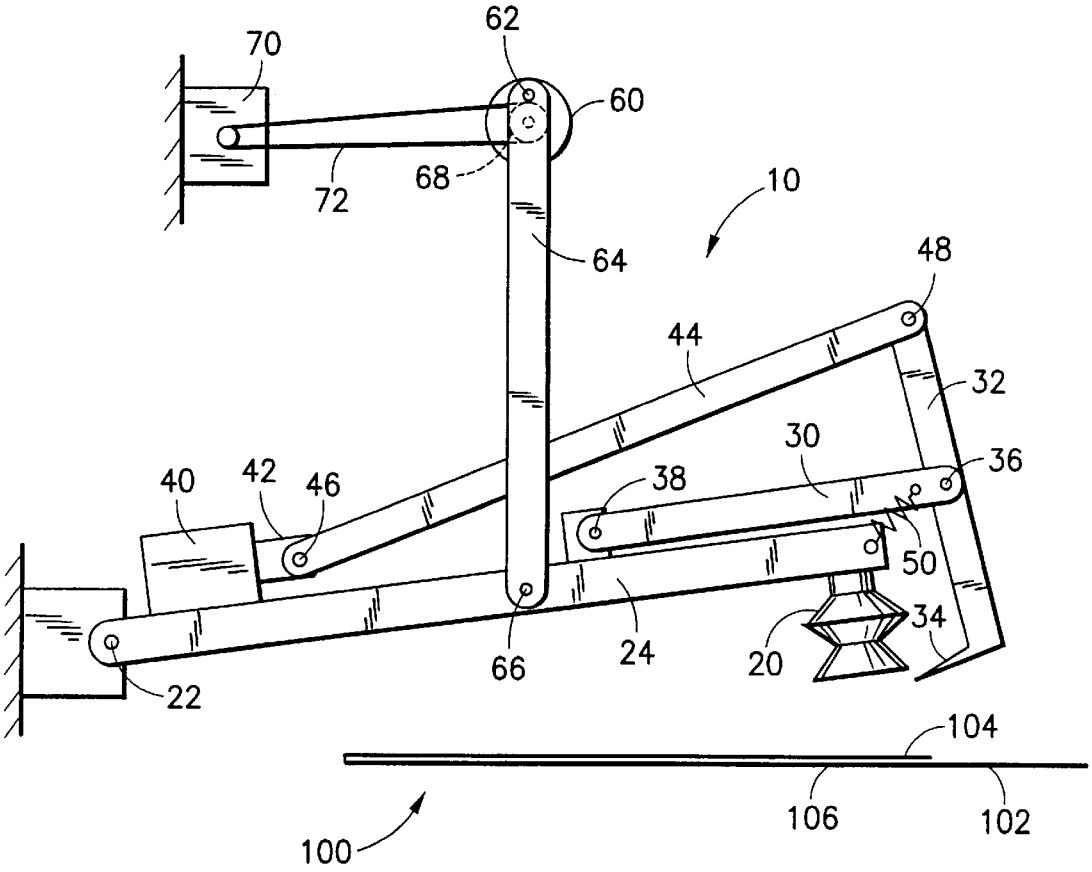
FIG. 2 illustrates the envelope opening device, according to the present invention, and an envelope being positioned under the envelope opening device.

FIG. 2 illustrates an envelope 100 positioned under the envelope opening device 10 that is in a raised position. As shown in FIG. 2, the envelope opening device 10 includes a suction cup 20 mounted on a pitching arm 24 which is pivotably mounted at pivot point 22 to a platform of an inserting machine or any platform where the envelope opening device 10 is used; a link 30 pivotably mounted to the pitching arm 24 at pivot point 38; and a finger 32 having a hook 34 which extends from the lower end of the finger 32 and is adjacent the suction cup 20. As further shown in FIG. 2, the finger 32 is pivotably connected at pivot point 36 to the link 30 and the upper end of the finger 32 is also movably connected to a shaft 42 of a solenoid 40 by an interconnecting actuator arm 44. Preferably, shaft 42 of the solenoid 40 is connected to one end of the actuator arm 44 at pivot point 46 thereby allowing actuator arm 44 and shaft 42 to move relative to each other. The other end of the actuator arm 44 is pivotably connected to the upper end of finger 32 at pivot point 48. Envelope opening device 10 can be pitched up and down by a cam 60 through a cam link 64 which is pivotably connect to the can 60 at pivot point 62 and the pitching arm 24 at pivot point 66. It is preferred that the cam 60 be driven by a motor 70 with a belt 72 and a pulley 68.

As shown in FIG. 2, the envelope opening device 10 is in a raised position to allow the envelope 100 to be placed under the envelope opening device 10 with the throat portion 104 properly positioned under the suction cup 20. Reference numeral 106 denotes the lower side of the envelope 100. At this first stage of the envelope opening cycle, it is preferred that the solenoid 40 not be energized so that the solenoid shaft 42 is retracted into the solenoid 40 so as to pull the upper section of the finger 32 toward the solenoid 40. Consequently, the hook 34 on the lower end of the finger 32 is kept away from suction cup 20.

Figure 3:
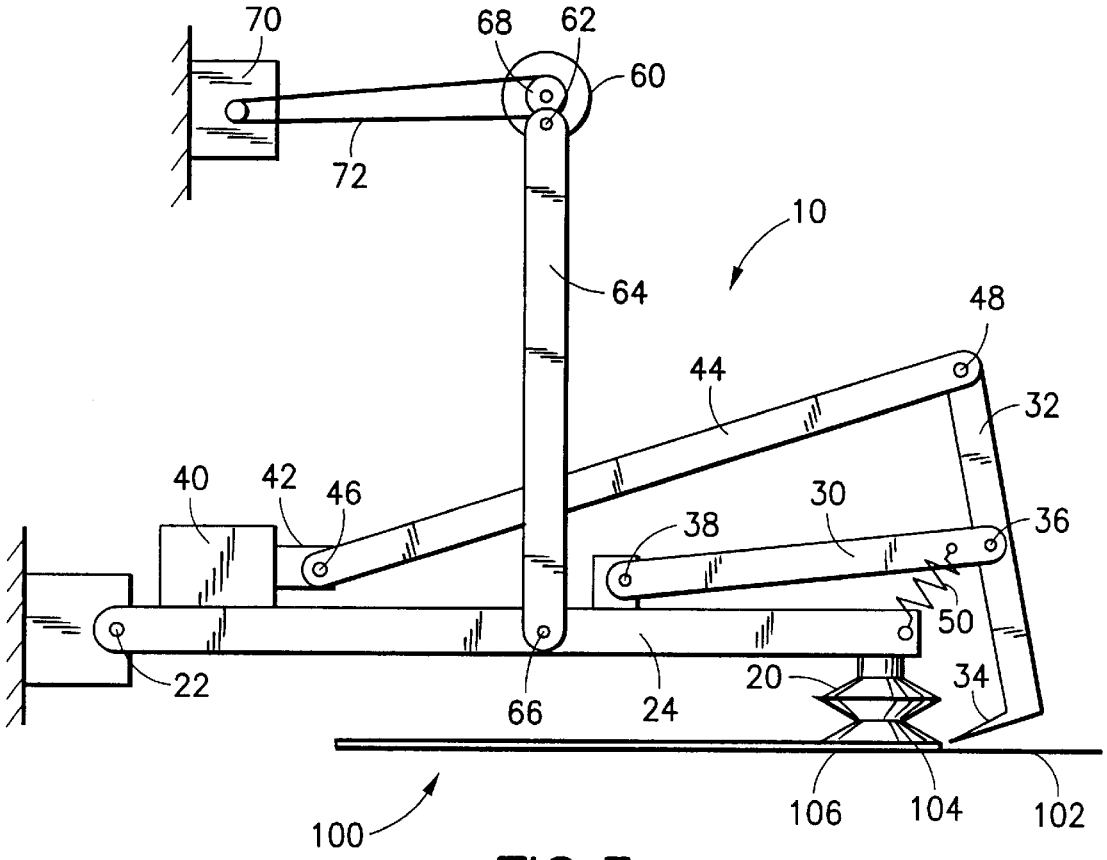
FIG. 3 illustrates the envelope opening device being lowered to cause the suction cup to contact the throat of the envelope.
Figure 7:
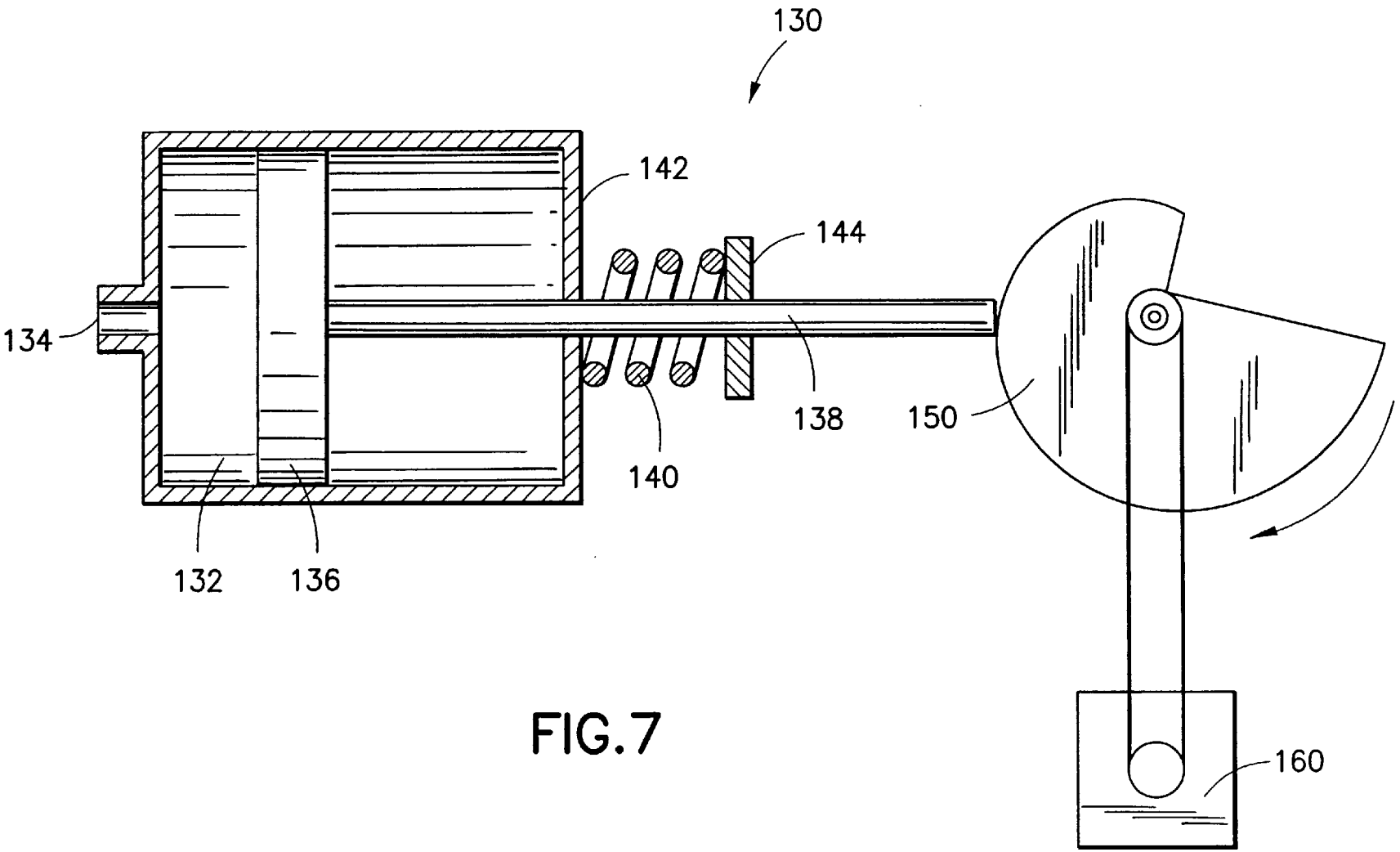
FIG. 7 illustrates a single-shot piston vacuum pump for facilitating a suction force for the suction cup.

FIG. 3 illustrates the envelope opening device 10 being lowered by the action of the cam 60 to cause the suction cup 20 to press against the throat portion 104 of the envelope 100. Because of the movement allowed at pivot points 36, 38, 46 and 48, the finger 32 can be pushed upward by the surface (not shown) on which the envelope 100 is located. Consequently, the hook 34 is displaced so as to allow the suction cup 20 to contact with the envelope throat 104. As further shown in FIG. 3, the suction cup 20 is compressed by the vacuum or a low air pressure inside the cup 20 to seal against the throat portion 104 of the envelope 100 which is now unopened. The vacuum or the low air pressure is caused by a vacuum pump (not shown in FIGS. 2–5) operatively connected to the suction cup 20 in a conventional manner, and the low air pressure is defined as being a pressure lower than the atmospheric pressure. Because the suction force on the suction cup 20 is needed only for a very short period of time, it is preferred that a small vacuum pump having a small single-shot piston (or diaphragm, or bellows) be used to draw air from the suction cup 20. An exemplary single-shot piston vacuum pump is shown in FIG. 7 and is discussed in more detail below. At this second stage of the envelope opening cycle, the solenoid 40 is not energized.

Figure 4:
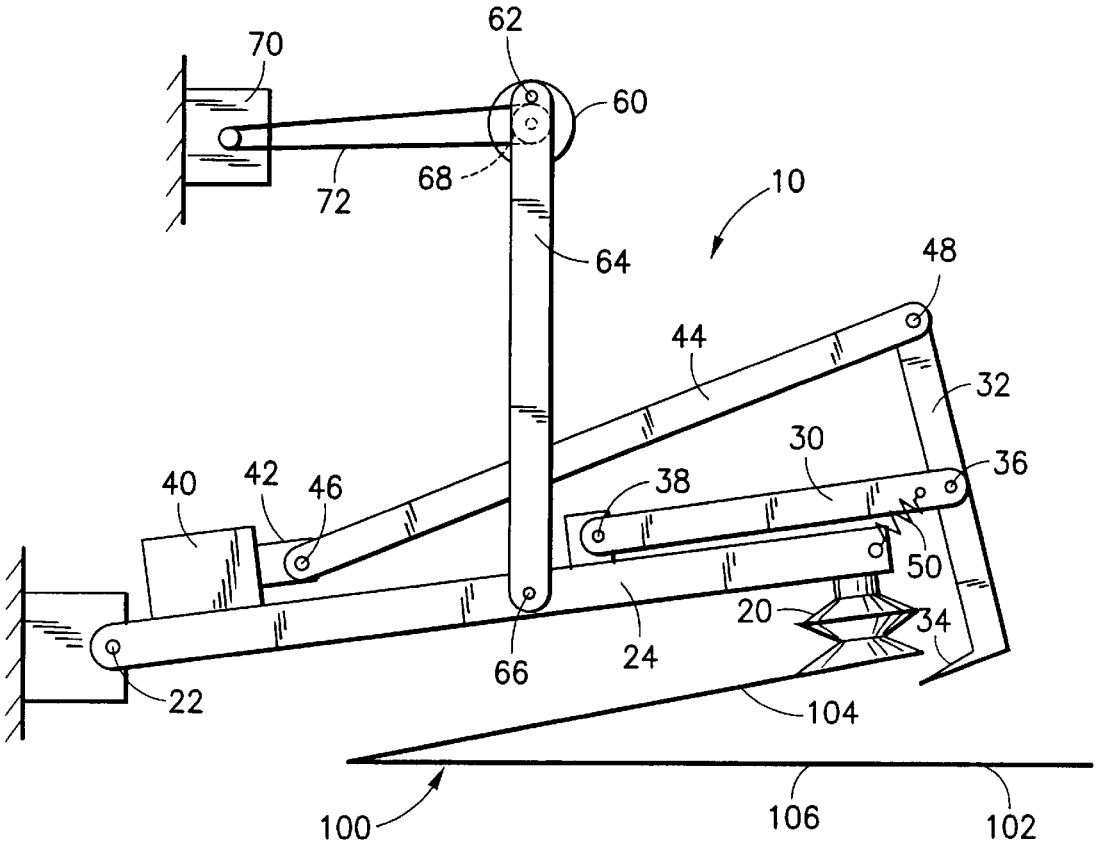
FIG. 4 illustrates the suction cup being raised to lift the throat to spread open the envelope.

FIG. 4 illustrates the envelope opening device 10 being pitched up by the action of the cam 60 to raise the suction cup 20 along with the throat portion 104 in order to spread open the envelope 100. As shown, the throat portion 104 of the envelope 100 is separated from the lower side 106 of the envelope 100 into an envelope opening position. Typically in an inserting machine, the lower side 106 of the envelope 100 is held down by mechanical fingers or another vacuum suction device while the throat portion 100 is lifted by suction cup 20. It is preferred that link 30 be spring loaded so that when the pitching arm 24 is raised, the link 30 and the hook 34 automatically return to their original positions relative to the cup 20 as depicted in FIG. 2. For example, a spring 50 is provided between link 30 and pitching arm 24 as shown. Now the envelope 100 is opened by the suction force and the raised position of the pitching arm 24. At this third stage of the envelope opening cycle, the solenoid 40 remains un-energized and the solenoid shaft 42 is in the retracted position.

Figure 5:
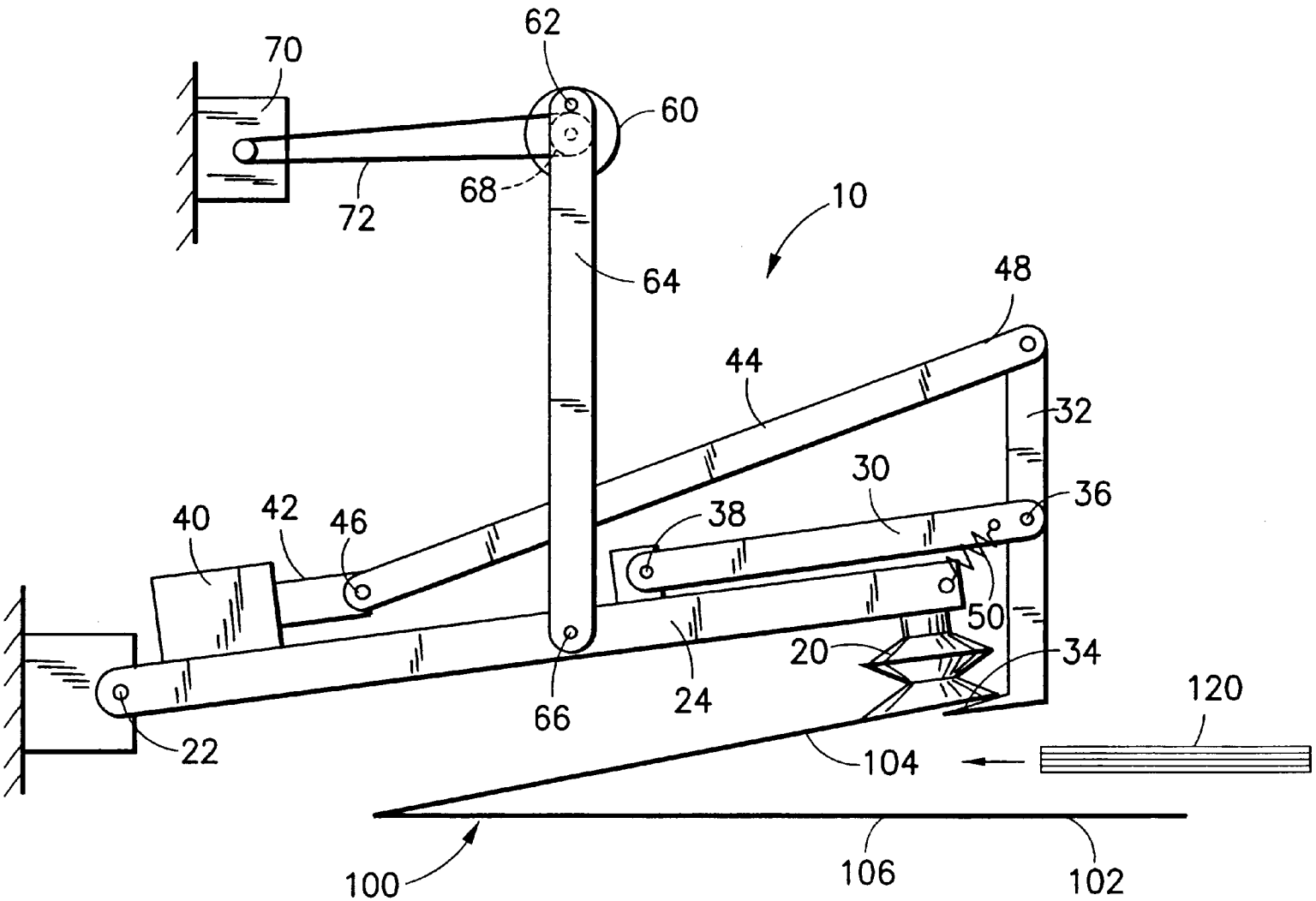
FIG. 5 illustrates the hook being placed under the throat to maintain the opening position of the envelope.

FIG. 5 illustrates the hook 34 being placed under the throat portion 104 to mechanically maintain the opening position of the envelope 100. As shown in FIG. 5, the solenoid 40 is energized in order to push the solenoid shaft 42 outward and place the hook 34 under the compressed suction cup 20. As the envelope opening position is mechanically retained, the vacuum pump or piston that provides the low air pressure to the suction cup 20 can now be reset to its charged position (see discussion below in conjunction with FIG. 7). At the same time, enclosure material 120 can be inserted into the envelope 100. After the enclosure material 120 is properly inserted and the envelope opening position is no longer needed to be maintained, solenoid 40 is de-energized to allow the hook 34 to return to its original position and the envelope throat 104 is separated from the suction cup 20, ready for the next envelope opening cycle.

With the present invention, the vacuum or low air pressure in the suction cup 20 is only needed for a short time, just long enough to pickup and lift the envelope throat 104 and to place the hook 34 under the envelope throat 104. After that, the envelope opening position is mechanically maintained by keeping the solenoid 40 energized.

It should be noted that the illustrations in FIGS. 2 through 5 are for illustrative purposes only. They are intended to show the method of maintaining the envelope in the opening position by a simple mechanical device with a few simple steps. The method and device, according to the present invention, have been described with respect to a preferred version and embodiment thereof. It will be understood by those skilled in the art that many different embodiments can be made to take advantages of the foregoing teaching. For example, in FIGS. 2 through 5, the pivot point 36 between link 30 and finger 32 is located between the hook 34 and the connecting point 48 of the finger 32 to the actuation arm 44. But the locations of the connecting point 48 and pivot point 36 can be interchanged with minor design changes. Furthermore, although it has been depicted in FIGS. 2 to 5 that the solenoid shaft 42 is pushed outward by energizing the solenoid 40 and retracted by de-energizing the solenoid 40, the shaft 42 can also be pushed outward by de-energizing the solenoid 40 and retracted by energizing the solenoid 40. Moreover, ball joints can be used where pivot points are used to connect one component to another. Also, slots and pins can be used in lieu of pivots, as shown in the embodiment illustrated in FIG. 6.

Figure 6:
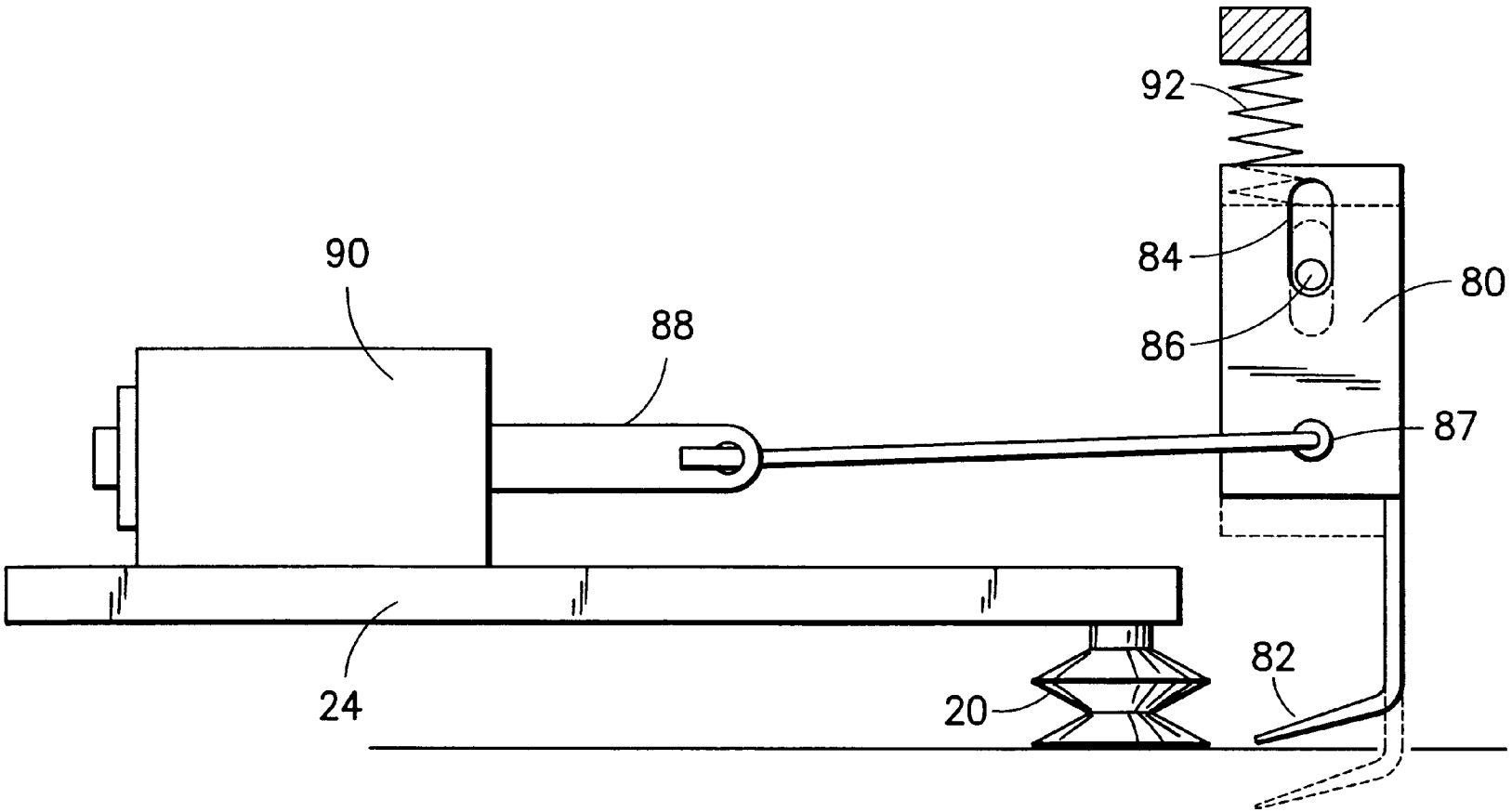
FIG. 6 illustrates another embodiment of the present invention.

FIG. 6 illustrates another embodiment of the present invention. As shown in FIG. 6, a finger 80, which has a slot 84 on one end and a hook 82 on the other end, is pivotably connected to a shaft 88 of an solenoid 90. Slot 84 is movably engaged with a pivot pin 86. When the solenoid 90 is not energized, the hook 82 is kept away from the suction cup 20 by the out-extending solenoid shaft 88 so as to allow the suction cup to press against the throat portion of an unopened envelope (not shown). When the suction cup 20 is raised along with the pitching arm 24 (similar to the situation as illustrated in FIG. 4) to spread open the envelope 100, slot 84 and pivot pin 86 allow the hook 82 to move downward (as shown in phantom lines) by the downward pushing force of the spring 92. When the solenoid 90 is energized, the solenoid shaft 88 is retracted into the solenoid 90 to move the hook 82 toward the suction cup 20 in order to retain the opening position of the envelope, similar to the situation as illustrated in FIG. 5.

In FIG. 7, there is shown a single-shot piston vacuum pump 130 which includes a front air chamber 132, an air inlet 134, and a piston 136 connected to a shaft 138. A flange 144 is fixedly mounted to the shaft 138 beyond the back side 142 of the vacuum pump 130. A spring 140 located and compressed between the flange 144 and the back side 142 of the vacuum pump 130 is used to provide a biasing force to the piston 136, urging the piston 136 to move away from the inlet 134. The shaft 138 is in contact with a cam 150 which is driven by a motor 160 to rotate in a clockwise direction. When the piston 136 is released by the cam 150 such that the piston is allowed to move away from the inlet 134 under the urging of the spring 140, the front air chamber 132 is expanded and air is drawn into the air chamber 132 through the air inlet 134. When a suction cup (not shown) is operatively connected to the air inlet 134, air is also drawn from the suction cup by the expanding air chamber 132, creating a suction force within the suction cup.

When it is time to remove the suction force, the cam 150 is again rotated by motor 160 in order to push the piston 136 toward the inlet 134 to minimize the volume of the air chamber 132, resetting the vacuum pump 130 to its recharged position.

It should be noted that although the envelope opening devices depicted in FIGS. 2 through 6 have been described as an envelope opener, the same device can be used, in general, to lift a surface by a suction force to a lifted position and to mechanically maintain the surface in the lifted position.

Although the invention has been described with respect to preferred versions and embodiments thereof, it will be understood by those skilled in the art that the foregoing and various other changes, omissions and deviations in the form and detail thereof may be made without departing from the spirit and scope of this invention.

What is claimed is:

1. A device for lifting a throat of an envelope to a lifted position, comprising:

a suction device sealed against the throat by a suction force within the suction device;

a mechanical device located adjacent said suction device;

a first means for moving the suction device so as to lift the throat to the lifted position;

second means for placing the mechanical device under the throat after the throat has been lifted to the lifted position by the suction device so as to mechanically maintain the throat at the lifted position at times when the suction force is removed to permit the insertion of materials into the envelope; and a pitching arm upon which the suction device is mounted, wherein the first means lowers the pitching arm so that the suction device contacts and seals against the throat and raises the pitching arm so that the suction device lifts the throat to the lifted position;

wherein the mechanical device includes a finger movably connected to the pitching arm, the finger having a hook which is located adjacent to the suction device and which is movable between a first position under the suction device and a second position removed from the suction device, and wherein the second means is used to move the finger whereby the hook is placed in the first position after the throat has been lifted to the lifted position thereby mechanically maintaining the throat at the lifted position at times when the suction force is removed;

wherein the second means comprises a solenoid which is operable in a first state to cause the hook to be placed in the first position under the suction device and in a second state to cause the hook to be placed in the second position removed from the suction device.

2. The device of claim 1, wherein the solenoid is operable at the first state when the solenoid is energized and is operable at the second state when the solenoid is un-energized.

3. The device of claim 1, wherein the solenoid is operable at the first state when the solenoid is un-energized and is operable at the first state when the solenoid is energized.

4. The device of claim 1 further comprising a shaft operatively connected to the solenoid and the finger, wherein the shaft is caused to extend outward of the solenoid when the solenoid is operated in the first state so as to place the hook in the first position.

5. The device of claim 1 further comprising a shaft operatively connected to the solenoid and the finger, wherein the shaft is caused to retract toward the solenoid when the solenoid is operated in the first state so as to place the hook in the first position.

6. The device of claim 1 further comprising a spring which urges the hook to return to the second position when the solenoid is operated in the second state.

7. The device of claim 1 further comprising a link having a first end and an opposing second end, wherein the link is pivotably mounted to the pitching arm at the first end and movably connected to the finger at the second end for pivotal movement, and wherein the solenoid is used to move the finger in order to cause the hook to move between the first and second positions via the pivotal movement between the link and the finger.

8. The device of claim 1, further comprising an actuation arm for movably connecting the solenoid and the finger.

9. The device of claim 1, further comprising a pin operatively connected to the solenoid, wherein the finger further includes a slot for engaging with said pin thereby allowing pivotal movement of said finger in response to operation of the solenoid.

* * * * *